US010359190B2

(12) United States Patent
Eberspach et al.

(10) Patent No.: US 10,359,190 B2
(45) Date of Patent: Jul. 23, 2019

(54) CATALYTIC BURNER, ESPECIALLY FOR A VEHICLE HEATER

(71) Applicant: Eberspacher Climate Control Systems GmbH & Co. KG, Esslingen (DE)

(72) Inventors: Günter Eberspach, Wolfschlungen (DE); Klaus Beetz, Karlsruhe (DE); Wolfgang Pfister, Esslingen (DE)

(73) Assignee: EBERSPÄCHER CLIMATE CONTROL SYSTEMS GMBH & CO. KG, Esslingen (DE)

( * ) Notice: Subject to any disclaimer, the term of this patent is extended or adjusted under 35 U.S.C. 154(b) by 859 days.

(21) Appl. No.: 14/144,867

(22) Filed: Dec. 31, 2013

(65) Prior Publication Data

US 2014/0186782 A1 Jul. 3, 2014

(30) Foreign Application Priority Data

Jan. 2, 2013 (DE) ..... 10 2013 200 016

(51) Int. Cl.
*F23D 5/12* (2006.01)
*F23D 3/40* (2006.01)
*F23C 13/06* (2006.01)

(52) U.S. Cl.
CPC ..... *F23D 3/40* (2013.01); *F23C 13/06* (2013.01); *F23D 5/123* (2013.01); *F23D 5/126* (2013.01); *F23D 2900/21002* (2013.01)

(58) Field of Classification Search
CPC ..... F23D 5/123; F23D 5/126
(Continued)

(56) References Cited

U.S. PATENT DOCUMENTS 3,635,651 A * 1/1972 Desty ..... F23D 3/08 431/328
3,796,207 A * 3/1974 Olson ..... F02N 19/10 123/142.5 R
3,901,213 A * 8/1975 Charboneau ..... F02N 19/10 122/21

(Continued)

FOREIGN PATENT DOCUMENTS

CN 102 109 169 A 6/2011
DE 195 14 369 A1 1/1996

(Continued)

OTHER PUBLICATIONS

DE19950894 A1, Oct. 2000—machine translation—English translation, printed Mar. 1, 2019 http://translationportal.epo.org (Year: 2000).*

(Continued)

*Primary Examiner* — Steven B McAllister
*Assistant Examiner* — Desmond C Peyton
(74) *Attorney, Agent, or Firm* — McGlew and Tuttle, P.C.

(57) ABSTRACT

A catalytic burner, especially for a vehicle heater, for the catalytically supported combustion of a fuel/combustion air mixture, includes a mixing chamber (24) and a combustion air feed device (36), for feeding combustion air to the mixing chamber (24) and a fuel feed device (28, 34), for feeding fuel to the mixing chamber (24), upstream of the mixing chamber (24). A catalyzer device (46) is provided with at least one catalyzer unit (48, 50, 52, 70), through which the fuel/combustion air mixture can flow. The fuel feed device (28, 34) includes an evaporator device (28) receiving liquid fuel from a fuel feed line (34) and releasing fuel vapor into the mixing chamber (24) or/and the at least one catalyzer unit (48, 50, 52, 70) includes a grid-like support with catalyst material on a surface of the a grid-like support.

13 Claims, 10 Drawing Sheets

(58) Field of Classification Search
USPC ..... 431/268, 258, 208, 11, 328; 123/142.5 R; 62/50.2; 48/197 FM
See application file for complete search history.

(56) References Cited

U.S. PATENT DOCUMENTS

| | | | | | |
|---|---|---|---|---|---|
| 3,911,896 | A * | 10/1975 | Charboneau | F24H 1/0045 | 122/21 |
| 4,927,353 | A | 5/1990 | Nomura et al. | | |
| 2003/0196381 | A1* | 10/2003 | Eberspach | B01B 1/005 | 48/197 FM |
| 2005/0005617 | A1* | 1/2005 | Jibb | F25B 23/006 | 62/99 |
| 2005/0136305 | A1* | 6/2005 | Eberspach | F23D 3/40 | 429/435 |
| 2005/0235654 | A1* | 10/2005 | Kaupert | B01B 1/005 | 62/50.2 |
| 2007/0273052 | A1* | 11/2007 | Schmidt | F23D 3/22 | 261/101 |
| 2008/0134580 | A1* | 6/2008 | Kah | B01B 1/005 | 48/197 FM |
| 2009/0123885 | A1 | 5/2009 | Vestin | | |
| 2014/0193759 | A1* | 7/2014 | Weber | F23C 7/06 | 431/314 |
| 2015/0102115 | A1* | 4/2015 | Collmer | B60H 1/2212 | 237/12.3 C |
| 2015/0102116 | A1* | 4/2015 | Pfister | B60H 1/2203 | 237/12.3 C |
| 2015/0102117 | A1* | 4/2015 | Collmer | B60H 1/2203 | 237/12.3 C |

FOREIGN PATENT DOCUMENTS

| | | | | | |
|---|---|---|---|---|---|
| DE | 199 50 894 | A1 | | 10/2000 | |
| DE | 103 60 458 | A1 | | 7/2005 | |
| DE | 10 2004 050 361 | B3 | | 3/2006 | |
| DE | 4447986 | B4 | * | 3/2006 | F23D 3/40 |
| EP | 1 970 624 | A2 | | 9/2008 | |
| FR | 2 329 936 | A1 | | 5/1977 | |
| JP | S58-127010 | A | | 7/1983 | |
| JP | S58-127011 | A | | 7/1983 | |
| JP | S6053711 | A | | 3/1985 | |
| JP | 04314613 | A | * | 11/1992 | |
| JP | H05-157211 | A | | 6/1993 | |
| JP | H06-137538 | A | | 5/1994 | |
| JP | H07-301404 | A | | 11/1995 | |
| JP | H08-100907 | A | | 4/1996 | |
| JP | H11-37426 | A | | 2/1999 | |
| JP | 2001-050508 | A | | 2/2001 | |
| JP | 2001-065815 | A | | 3/2001 | |
| JP | 2003-21 322 | A | | 1/2003 | |
| JP | 2003090512 | A | * | 3/2003 | |
| JP | 2004-251579 | A | | 9/2004 | |
| JP | 2008-527300 | A | | 7/2008 | |
| WO | 2006/074622 | A1 | | 7/2006 | |
| WO | 2007/003649 | A1 | | 1/2007 | |
| WO | 2010/074767 | A1 | | 7/2010 | |

OTHER PUBLICATIONS

Chinese Office Action dated Dec. 2, 2016.

* cited by examiner

CATALYTIC BURNER, ESPECIALLY FOR A VEHICLE HEATER

CROSS REFERENCE TO RELATED APPLICATIONS

This application claims the benefit of priority under 35 U.S.C. § 119 of German Application DE 10 2013 200 016.2 filed Jan. 2, 2013, the entire contents of which are incorporated herein by reference.

FIELD OF THE INVENTION

The present invention pertains to a catalytic burner, especially for a vehicle heater, for the catalytically supported combustion of a fuel/combustion air mixture, comprising a mixing chamber, a combustion air feed device for feeding combustion air to the mixing chamber, a fuel feed device for feeding fuel to the mixing chamber, and a catalyzer device upstream of the mixing chamber with at least one catalyzer unit, through which the fuel/combustion air mixture can flow.

BACKGROUND OF THE INVENTION

Fuel-operated heaters are used as parking heaters or auxiliary heaters for supplying heat in motor vehicles. A mixture of fuel and combustion air is ignited and burnt in these. The heat generated in the process is transmitted to a heat carrier medium, for example, the air to be introduced into an interior chamber of the vehicle or to the cooling agent circulating in an engine coolant system. Catalytic burners (catalytic combustion (reaction) devices) are known to be used in order to make it possible to meet the ever-increasing requirements imposed in terms of pollutant emission, especially also during the start-up phase of combustion. The combustion of fuel and combustion air is achieved in these by a process supported catalytically on the surface of catalytic material.

Such a catalytic burner is known from WO 2007/003649 A1. The fuel fed through a fuel feed line in the form of droplets is introduced in this catalytic burner into a pot-like evaporator. This evaporator is open opposite the direction of flow of the combustion air being fed with the fuel for combustion. The combustion air flowing into the pot-like evaporator leads to swirling in the interior of this pot-like (pot shaped) evaporator, and this swirling leads to thorough mixing of the combustion air with the fuel accumulating therein. The mixture thus formed from combustion air and fuel leaves the pot-like evaporator via an edge area of a circumferential wall of said pot-like evaporator and then reaches further to a combustion chamber, in which the catalyzer device with a plurality of catalyzer units, which follow each other in the direction of flow and through which the fuel/combustion air mixture can flow, for the combustion of this fuel/combustion air mixture.

SUMMARY OF THE INVENTION

An object of the present invention is to provide a catalytic burner (catalytic combustion (reaction) device), especially for a vehicle heater, with which a more efficient catalytically supported combustion process can be achieved.

This object is accomplished according to the present invention by a catalytic burner, especially for a vehicle heater, for the catalytically supported combustion of a fuel/combustion air mixture, comprising a mixing chamber, a combustion air feed device for feeding combustion air to the mixing chamber, a fuel feed device for feeding fuel to the mixing chamber, a catalyzer device downstream of the mixing chamber with at least one catalyzer unit, through which the fuel/combustion air mixture can flow.

Provisions are made, furthermore, for the fuel feed device to comprise a porous evaporator device, which accommodates a fuel feed line and releases fuel vapor into the mixing chamber, or/and for at least one catalyzer unit to comprise a grid-like support (a grid support) with catalyst material on its surface.

Measures that markedly improve the quality of the catalytically supported combustion of the fuel/combustion air mixture are taken individually and in combination in the catalytic burner designed according to the present invention. Efficient mixing of fuel and combustion air is guaranteed by providing a porous evaporator device, because the fuel, which is generally fed in the liquid form, received in the porous evaporator device, is distributed therein due to capillary action, possibly also supported by the effect of the force of gravity, and is released into the mixing chamber on the comparatively large surface of this porous evaporator device. This fuel vapor can be mixed with the combustion air in the mixing chamber and in an area of the chamber that may follow same downstream. The risk that major accumulations of liquid fuel will develop or fuel will be entrained in the combustion air in the form of droplets can be ruled out hereby essentially completely. The provision of at least one catalyzer unit with a grid-like support and catalyst material on the surface thereof can also improve the catalytically supported combustion process. It is possible due to a catalyzer unit of such a design to provide the grid-like support in a three-dimensional configuration adapted to the structural conditions in the catalytic burner, to possibly deform this support, as a result of which the flow characteristics can be improved, on the one hand, and the surface of such a catalyzer unit, which surface is made available for the catalytically supported combustion, can be increased, on the other hand.

In one embodiment, that guarantees efficient mixing of the combustion air with fuel, especially with fuel vapor released from a porous evaporator device, a burner housing defines with a circumferential wall a combustion chamber containing at least one catalyzer unit, wherein a projection with a circumferential wall and with a bottom wall arranged offset in relation to the bottom wall of the burner housing in the direction of a longitudinal axis is provided at a bottom wall of the burner housing, wherein at least one part of the porous evaporator device is carried at the circumferential wall or/and the bottom wall of the projection.

To make it possible to use the inner volume area of the projection as a mixing chamber or at least part of the mixing chamber, at least one flow opening leading to the combustion chamber is provided in the circumferential wall of the projection and that at least one part of the evaporator device be provided at the circumferential wall or/and the bottom wall of the projection on a side facing away from the combustion chamber.

The passage of fuel and combustion air from the mixing chamber to an area following same downstream, in which the catalyzer device is also arranged, can be guaranteed by at least one flow opening being provided in an area of the circumferential wall that is located close to the bottom wall of the projection or/and by at least one flow opening being provided in an area of the circumferential wall of the projection, which area is located close to the bottom wall of the burner housing.

At least one and preferably each flow opening in the circumferential wall of the projection is advantageously covered by a catalyzer unit.

To make it possible to provide this catalyzer unit with the largest possible surface that can be used for the catalytic reaction, it is proposed that at least one and preferably each flow opening in the circumferential wall of the projection is covered by a catalyzer unit.

Provisions may be made in an alternative embodiment of the catalytic burner designed according to the present invention for at least one part of the porous evaporator device to be provided on a side of the circumferential wall facing the circumferential wall of the burner housing and for at least one flow opening leading to the mixing chamber to be provided in the circumferential wall of the burner housing in the area of the axial extension of the projection. A volume area between the circumferential wall of the burner housing and the circumferential wall of the projection is used as the mixing chamber in this design. The mixture of fuel and combustion air formed there can then be delivered in the downstream direction to the catalyzer device. Provisions may now be made, in particular, for a chamber formed between the circumferential wall of the burner housing and the circumferential wall of the projection to be defined at least partly by a catalyzer unit at its end area located a distance from the bottom wall of the burner housing. This catalyzer unit consequently defines essentially the mixing chamber and thus ensures that a first stage of the catalytically supported combustion can take place immediately during the discharge of the fuel/combustion air mixture from the mixing chamber.

It is further proposed, in an especially advantageous embodiment, that at least one flow diaphragm with at least one flow opening be provided at the circumferential wall of the burner housing and that at least one, preferably each flow opening is covered by a catalyzer unit. The provision of one or more flow diaphragms and catalyzer units associated therewith guarantees that the release of heat in the area of a respective catalyzer unit being positioned here can be controlled by a comparatively high flow velocity of the fuel/combustion air mixture to be catalyticly combusted and local overheating is consequently prevented.

The efficiency of the catalytically supported combustion can be further increased by a chamber formed between the projection and a flow diaphragm being divided by a catalyzer unit into a radially outer chamber area and a radially inner chamber area. It is proposed in an alternative design of the catalytic burner designed according to the present invention that a burner housing with a circumferential wall define a combustion chamber containing at least one catalyzer unit and that at least one part of the porous evaporator device be provided at the circumferential wall of the burner housing or/and at a bottom wall of the burner housing. The projection discussed above can consequently be essentially eliminated in such a design. The circumferential wall or/and the bottom wall of the burner housing may also assume at the same time the functionality of a support for at least one part of the porous evaporator device.

Provisions may now be made, for example, for the porous evaporator device to be provided on an outer side of the bottom wall facing away from the combustion chamber and for at least one flow opening leading to the combustion chamber to be provided in the circumferential wall of the burner housing, preferably in an area located close to the bottom wall. The entire volume enclosed by the circumferential wall and the bottom wall of the burner housing can consequently be used essentially as a combustion chamber in this design. The mixing of the fuel with the combustion air takes place upstream and outside this volume.

The catalytically supported combustion can be carried out especially efficiently in this design if at least one, preferably each flow opening is covered by a catalyzer unit. In particular, the catalyzer unit may be arranged now on an inner side of the circumferential wall of the burner housing facing the combustion chamber, so that large parts of the surface of the catalyzer unit are located such that they face the combustion chamber and can be used for the catalytically supported reaction.

It is proposed in an alternative embodiment, that the porous evaporator device be provided on an inner side of the bottom wall of the burner housing facing the combustion chamber and that at least one flow opening leading to the mixing chamber be provided in the circumferential wall of the burner housing, preferably in an area located close to the bottom wall. Consequently, an area of the volume enclosed by the circumferential wall and the bottom wall of the burner housing forms here the mixing chamber or a part of the mixing chamber, which supports a compact design.

It is proposed in another alternative embodiment that the porous evaporator device designed essentially as a pot-like or shell-like evaporator device with a circumferential wall area and with a bottom wall area be carried at the circumferential wall. Based on the fact that the porous evaporator device is designed with a pot-like or shell-like configuration, its volume, which can be used to distribute the fuel fed at first in the liquid form and also its surface that can be used to evaporate the fuel can be increased. This also supports the efficient mixing of the fuel vapor released over a comparatively large surface with the combustion air flowing past this surface.

To make it possible to utilize the catalytically supported combustion process as efficiently as possible in this design of the porous evaporator device, it is proposed that a catalyzer unit be arranged at the evaporator device. In particular, provisions may now be made for the catalyzer unit to also comprise the catalyst material applied to the material of which the porous evaporator device is made. The porous material of the evaporator device consequently forms the support for the catalyst material here, so that an additional support can be eliminated here.

Even if the burner housing is built without a projection provided at its bottom wall, an efficient support of the combustion of the catalytic reaction can be achieved by at least one flow diaphragm being provided at the circumferential wall of the burner housing and by at least one, preferably each flow opening being covered by a catalyzer unit.

To make it possible to enlarge the surface available for the catalytic reaction, it is proposed that at least one catalyzer unit be formed in the upstream direction or in the downstream direction, preferably in an arc-shaped, conical or cylindrical manner. The design of a respective catalyzer unit with a grid-like support, which support can then be deformed to obtain the shape in which the catalyzer unit is installed, is especially suitable for this. This deformation may take place before or after the application of the catalyst material to the grid-like support not made of catalyst material. However, a grid-like support made entirely of catalyst material could also be brought to the shape needed for installation by deformation. Such a grid-like support made entirely of catalyst material also has catalyst material on its surface in the sense of the present invention.

To make it possible to support the evaporation of the fuel especially during the start-up phase of the combustion process in the design of a catalytic burner according to the present invention with a porous evaporator device, it is proposed that an electrically excitable heating means be associated with the porous evaporator device.

The present invention will be described in detail below with reference to the figures attached. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
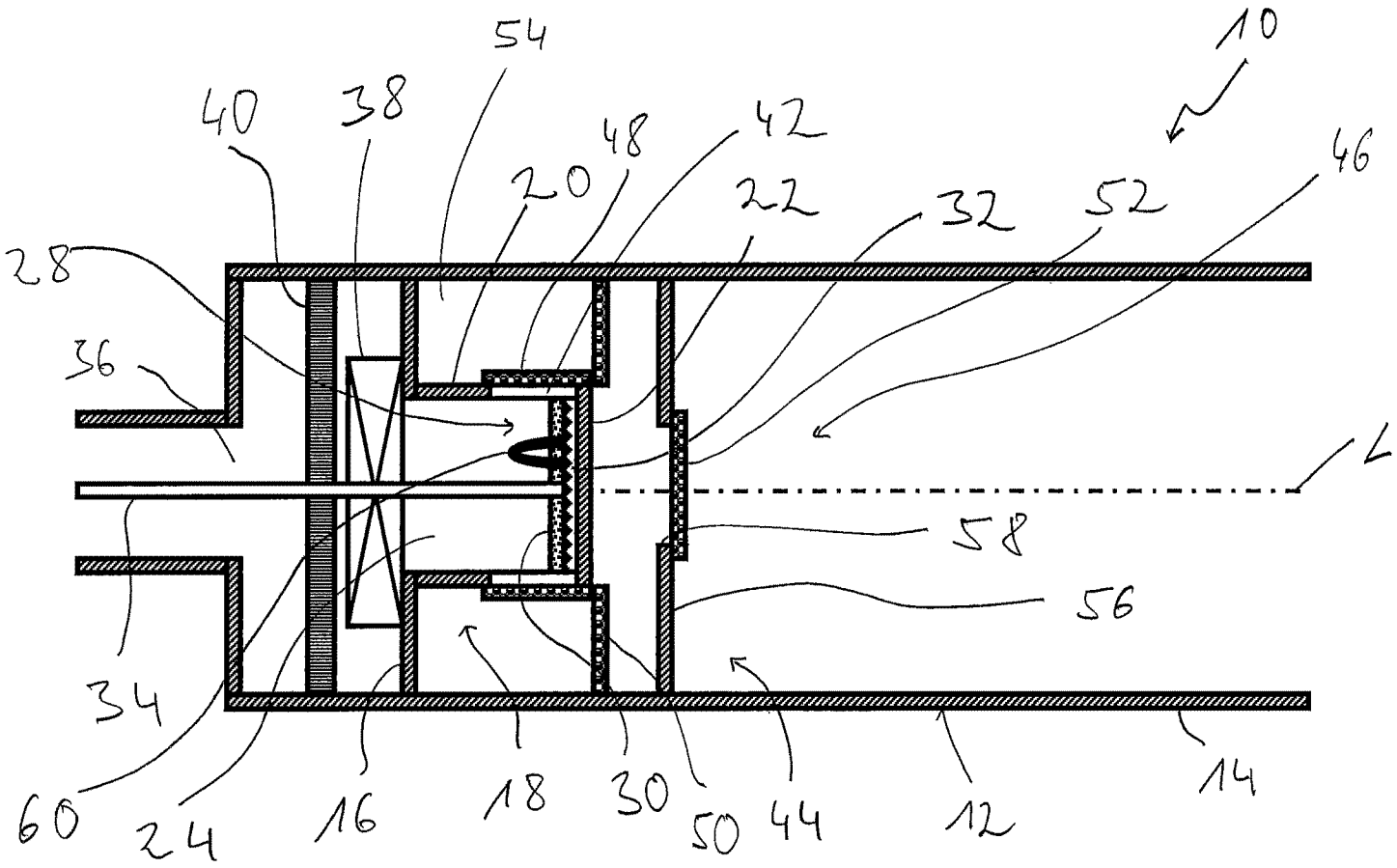
FIG. 1 is a longitudinal sectional view of a catalytic burner that can be used in a vehicle.

Referring to the drawings in particular, a catalytic burner that can be used as a parking heater or auxiliary heater in a vehicle is generally designated by 10 in FIG. 1. The catalytic burner 10 comprises a burner housing 12 elongated in the direction of a longitudinal axis L with an essentially cylindrical circumferential wall 14 and with a bottom wall 16. A projection 18, which comprises a circumferential wall 20, which is, for example, likewise essentially cylindrical, and a bottom wall 22 located offset in the direction of the longitudinal axis L in relation to the bottom wall 16 of the burner housing 12, is provided at the bottom wall 16, for example, in a central area.

A mixing chamber generally designated by 24 is provided in the interior of projection 18. A porous evaporator device 28 is provided or carried on the side of the bottom wall 22 of projection 18 facing this mixing chamber 24. This porous evaporator device 28 comprises a disk-shaped evaporator element 30 made of porous material. An electrically excitable heating means 32 is provided between this and the bottom wall 22 of projection 18. The evaporator element 30 may be made, for example, of nonwoven or braided material, foamed ceramic, metal foam or the like.

A fuel feed line extends, for example, concentrically with the longitudinal axis L in the direction of the longitudinal axis L through a volume area located upstream of the mixing chamber 24 into the mixing chamber 24 or into the evaporator element 30 provided at the bottom wall 22. Delivered by a fuel pump, not shown, for example, a metering pump, liquid fuel is fed into the evaporator element 30 via the fuel feed line 34. The liquid fuel is distributed in the inner volume of the porous evaporator element 30 due to the capillary action of said porous evaporator element 30 and evaporated into the mixing chamber 24 on the side of the evaporator element 30 facing the mixing chamber 24.

The volume through which the fuel feed line 34 passes upstream of the mixing chamber 24 forms a combustion air flow chamber 36. The air to be mixed in the mixing chamber 24 with the fuel evaporated there is fed, delivered by a combustion air blower, through this combustion air flow chamber 36. To achieve efficient mixing of this combustion air with the fuel vapor provided in mixing chamber 24, a swirling means 38, which ensures swirling of the combustion air introduced into the mixing chamber 24, may be carried at the bottom wall 16 of burner housing 12. A flame arrester 40, which prevents flames generated in the combustion process from flashing back into an area of the combustion air flow chamber 36 located farther upstream, may be provided farther upstream of the swirling means 38.

The fuel/combustion air mixture produced in the mixing chamber 24 reaches a combustion chamber of the catalytic burner 10 generally designated by 44 through a plurality of slot-like flow openings 42 formed in the circumferential wall 20 of projection 18. The flow openings 42 are elongated, for example, in the direction of the longitudinal axis L and adjoin the bottom wall 22 of projection 18.

A catalyzer device 46 is arranged in the combustion chamber 44. This comprises in the example shown in FIG. 1 three catalyzer units 48, 50, 52. The catalyzer unit 48 is essentially cylindrical and surrounds the circumferential wall 20 of projection 18 on the outer side thereof facing the circumferential wall 14 of the burner housing 12. The mixture flowing through the flow openings 42 into the combustion chamber 44 passes through the catalyzer unit 48, so that a part of the mixture reacts on the surface of the catalyzer unit 18 with the catalyst material provided there and is catalyticly combusted, supported by this catalyst material. Since the catalyzer unit 48 is arranged such that it surrounds the projection 18 over the entire circumference, a comparatively large surface can be used for a catalytically supported reaction.

After passing through the catalyzer unit 48, the mixture passing through the flow openings 42 enters a chamber 54 formed between the circumferential wall 20 of the projection and the circumferential wall 14 of the burner housing, which chamber is defined axially by the catalyzer unit 50 in an end area located close to the bottom wall 22 of projection 18. The catalyzer unit 50 may have a ring disk-shaped design and be carried on the inner surface of the circumferential wall 14 of the burner housing 12 or/and of the bottom wall 22 of projection 18 or/and of the catalyzer unit 48. The mixture entering chamber 54 can thus react on the surface of the catalyzer unit 48 during its flow through the flow openings 42 or during the flow in chamber 54 and, furthermore, it can react on the surface of the catalyzer unit 50 when leaving chamber 54 and hence during its passage through the catalyzer unit 50.

A flow diaphragm 56, which has, for example, a ring disk-shaped design, is carried farther downstream of the catalyzer unit 50 at the circumferential wall 14 of the burner housing 12. This has, for example, in its central area, a flow opening 58, which is covered by the disk-shaped catalyzer unit 52. The mixture flowing downstream of the catalyzer unit 50, i.e., downstream of chamber 54, in the direction of the flow diaphragm 56 and not yet catalyticly combusted at the catalyzer units 48, 50 can be catalyticly combusted in a last stage of the catalytic reaction at the catalyzer unit 52 in a catalytically supported manner, so that after flowing through the three catalyzer units 48, 50, 52 following each other in the direction of flow, the total quantity of fuel/combustion air mixture produced in mixing chamber 24 is essentially catalyticly combusted. The part of the circumferential wall 14 of the burner housing 12 that is located downstream of the flow diaphragm 56, i.e., the part still following the third catalyzer unit 52, can direct the combustion waste gases with the heat of combustion being carried therein, in the manner of a flame tube, towards a heat exchanger device, not shown in FIG. 1, where at least one part of the heat can be transferred to a heat carrier medium.

The catalyzer units 48, 50, 52 of the catalyzer device 46 may be designed, in principle, with a grid-like support, preferably one made of a metallic material, which is coated with catalyst material on its surface. Such a grid-like support makes possible the passage of mixture to be catalyticly combusted by a catalytically supported reaction, but can also be brought at the same time into the desired configuration suitable for installation in a simple manner by deformation. For example, the catalyzer unit 48, which has a generally cylindrical configuration, can thus be bent from a strip-like blank, whose end areas, which now face one another, can be connected to one another in a suitable manner, for example, by connection in material or by deformation. The grid-like support can be coated with the catalyst material before or after this shaping operation.

However, the design of the catalyzer units 48, 50, 52 could also be such, in principle, that the grid-like support itself is built up already from catalyst material and thus also has, of course, catalyst material on its surface for supporting the combustion.

A highly efficient combustion process with comparatively low pollutant emission is guaranteed with a catalytic burner 10 having the design shown in FIG. 1 due to the highly efficient mixing of the fuel vapor generated in the porous evaporator device 28 with the combustion air introduced into the mixing chamber 24, on the one hand, and due to the catalyzer units 48, 50, 52 being positioned at areas with comparatively high velocity of flow and intense swirling of the mixture leaving the mixing chamber 24, on the other hand. Since a comparatively high velocity of flow of the fuel/combustion air mixture and also of combustion waste gases generated during the combustion taking place already farther upstream is generated in the area of the catalyzer units 48, 50, 52 due to the positioning of said catalyzer units, it is guaranteed that overheating of the catalyzer units will not occur. Furthermore, efficient evaporation of fuel can be guaranteed even during the start-up phase due to the electrically excitable heating means 32 provided in association with the evaporator element 30 of the porous evaporator device 28, so that the pollutant emission can be reduced even during this phase at the beginning of the combustion. This can also be supported by the fact that an igniting means 60, for example, a glow type ignition pin, which can support the ignition of the mixture provided in mixing chamber 24 and hence even a combustion taking place in the mixing chamber 24, is provided in the mixing chamber 24.

Figure 2:
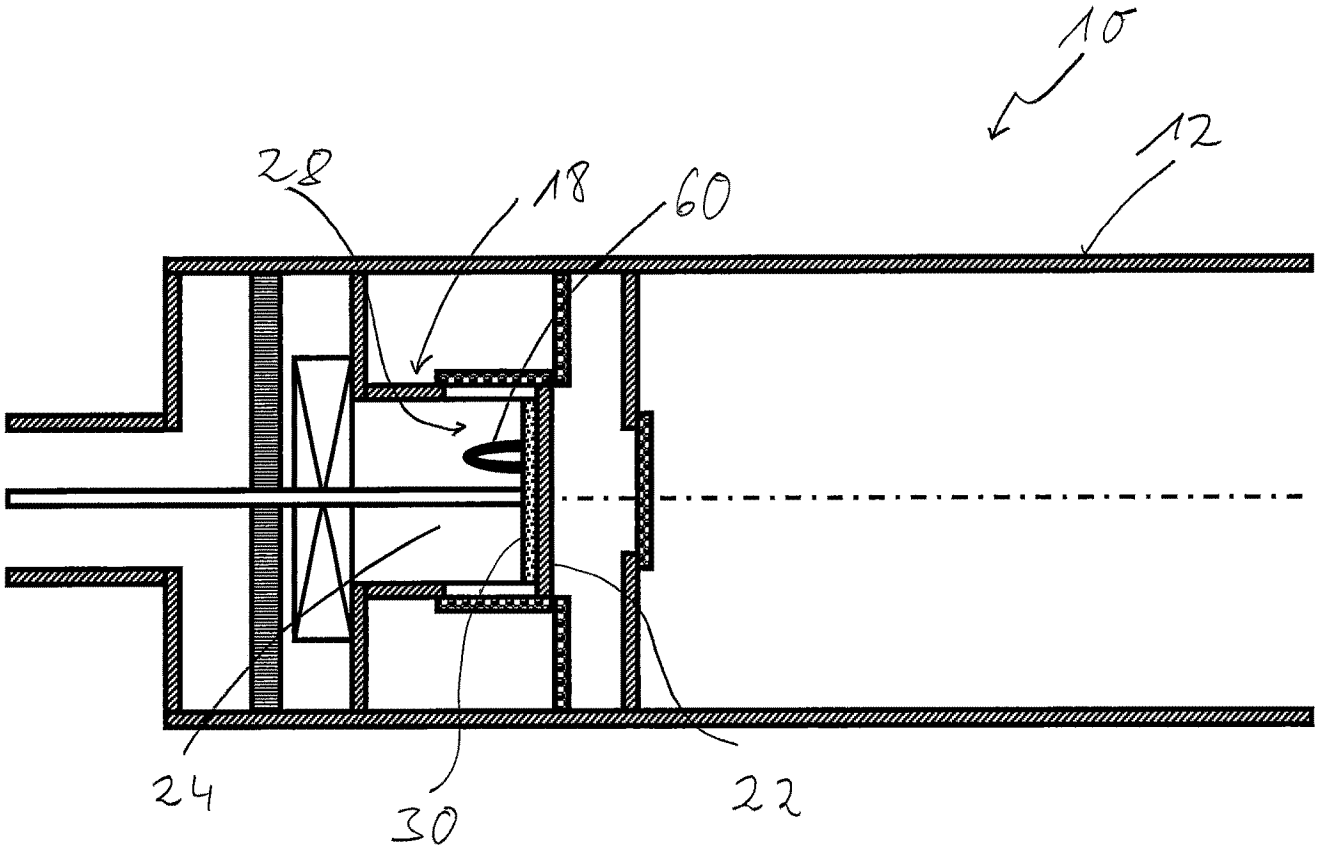
FIG. 2 is a longitudinal section of a variant of the catalytic burner shown in FIG. 1.

FIG. 2 shows a modified embodiment of the catalytic burner shown in FIG. 1. Components and assembly units that correspond to the components and assembly units described above are designated with the same reference numbers here as well as in FIGS. 3 through 5 following it. Only the differences existing from the previous embodiments will essentially be discussed with reference to FIG. 2 and the figures following it.

The evaporator element 30 of the porous evaporator device 28 is carried directly on the inner side of the bottom wall 22 of projection 18 facing the mixing chamber 24 in the design shown in FIG. 2. Consequently, no additional electrically excitable heating means is provided here. Evaporation of the fuel can be achieved during the start-up phase also with the additional support by the heat generated by the igniting means 60 and the combustion, which also takes place in the mixing chamber 24.

Figure 3:
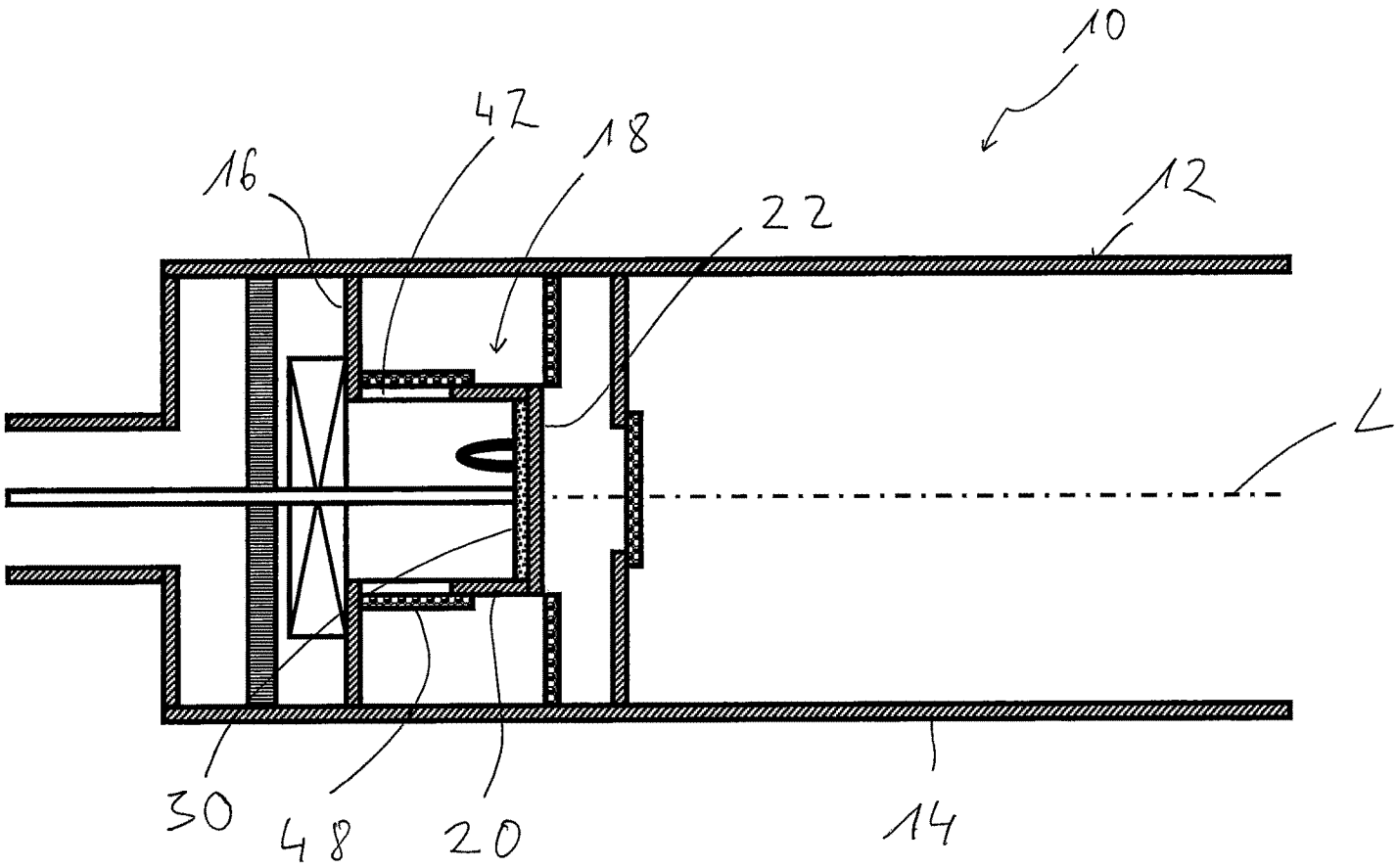
FIG. 3 is a longitudinal section of another variant of the catalytic burner shown in FIG. 1.

The slot-like flow openings 42 provided in the circumferential wall 20 of projection 18 are provided in the design shown in FIG. 3 at a spaced location from the bottom wall 22 of projection 18 but adjoining the bottom wall 16 of the burner housing 12. The catalyzer unit 48 covering the flow openings 42 is also located in this area of the length of the circumferential wall 20 and surrounds same on its outer side facing the circumferential wall 14 of the burner housing 12, but adjoining here the bottom wall 16 of the burner housing 12.

It should be pointed out that the electrically excitable heating means shown in FIG. 1 could, of course, also be provided between the evaporator element 30 and the bottom wall 22 of projection 18 in this embodiment variant shown in FIG. 3 as well.

Figure 4:
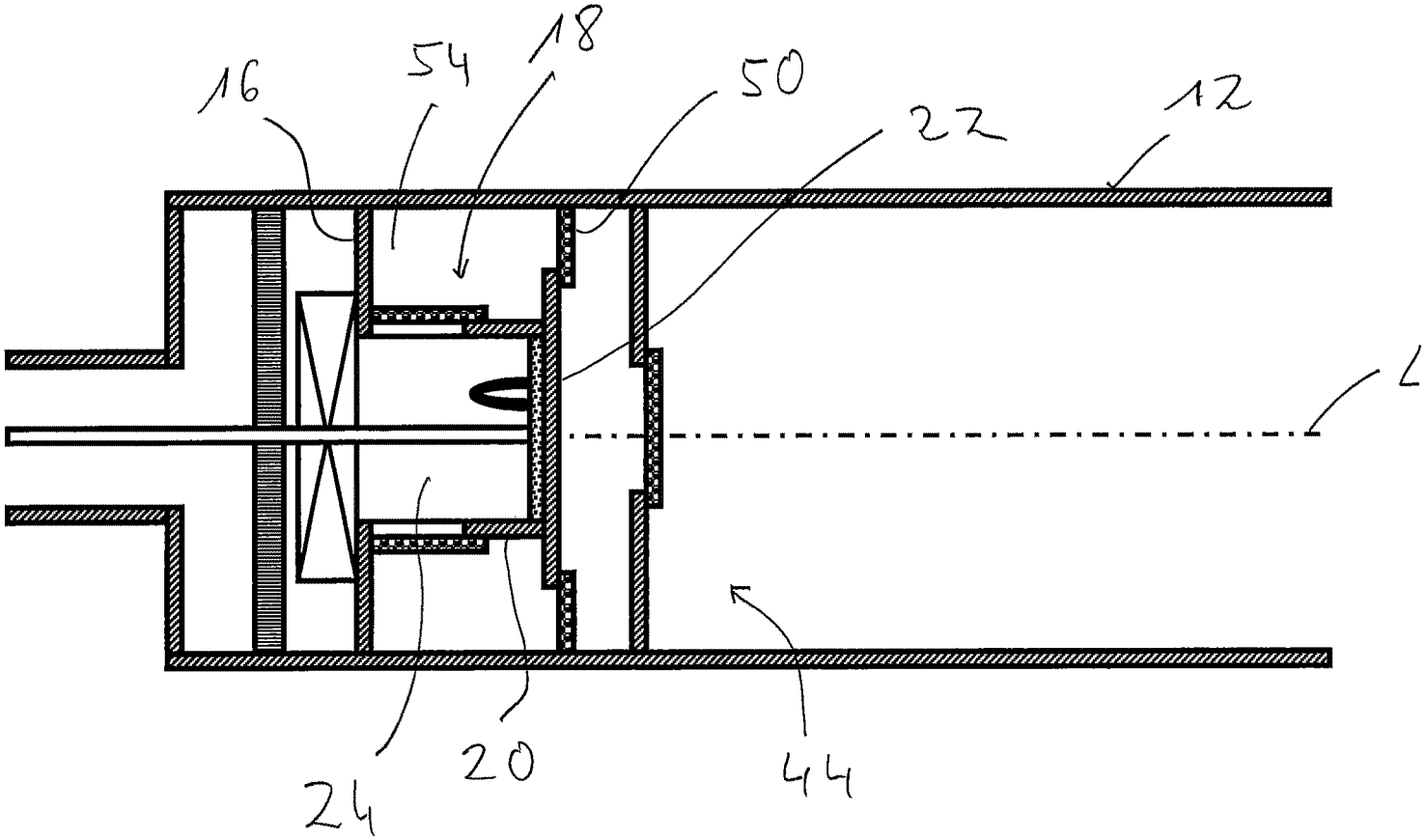
FIG. 4 is a longitudinal section of another variant of the catalytic burner shown in FIG. 1.

The bottom wall 22 of projection 18 extends radially relative to the longitudinal axis L over the circumferential wall 20 of the projection in the embodiment variant shown in FIG. 4, so that the chamber 54 is defined at its end area facing away from the bottom wall 16 of the burner housing 12 not only by the catalyzer unit 50, but also by a radially projecting part of the bottom wall 22. This leads to flow throttling and to an increase in the velocity of flow of the mixture flowing through from the mixing chamber 24 into the combustion chamber 44 and through the catalyzer unit 50 there and hence to improved dissipation of heat from the area of the catalyzer unit 50.

Figure 5:
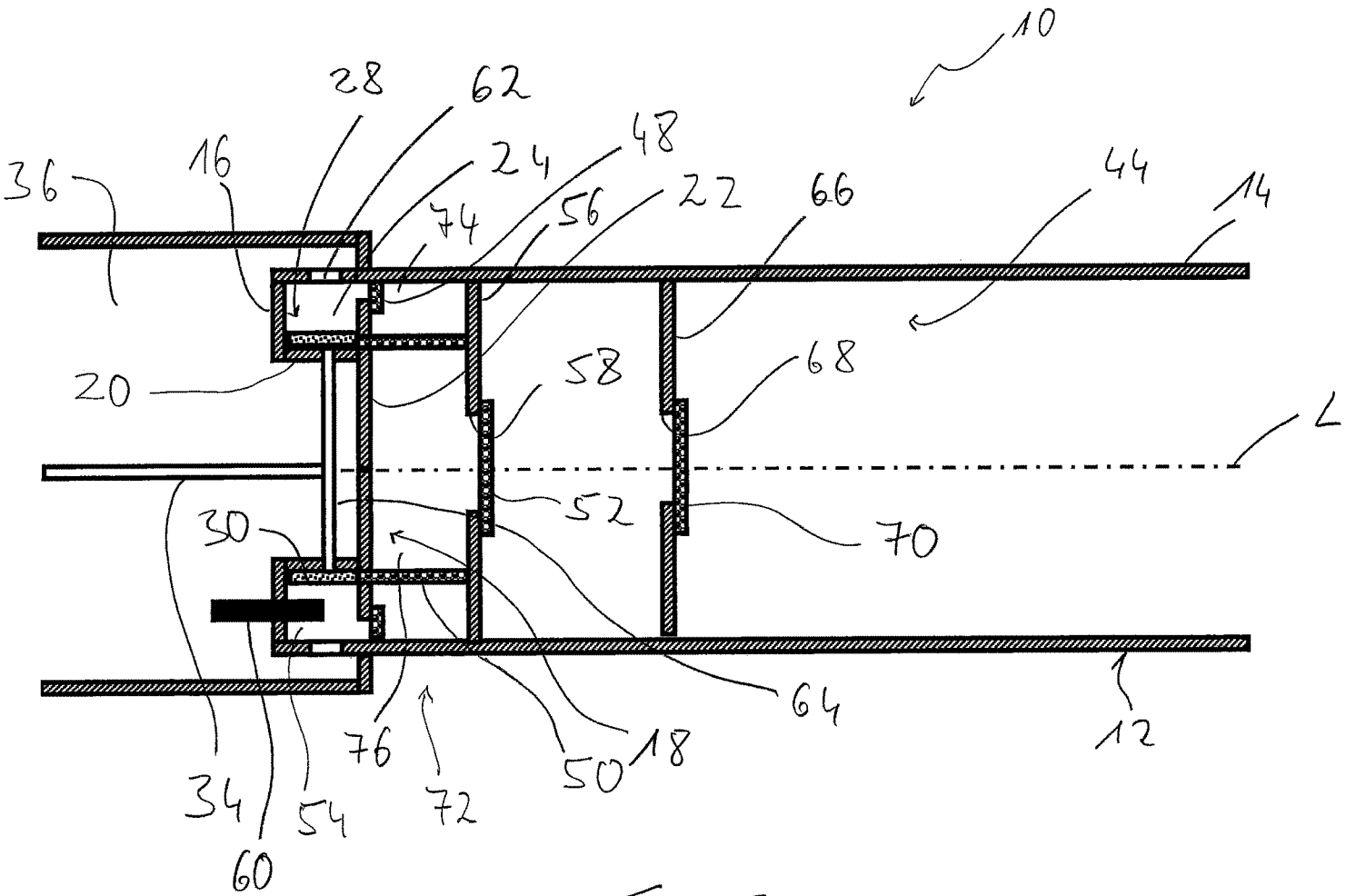
FIG. 5 is a longitudinal section of an alternative embodiment of a catalytic burner.

FIG. 5 shows the design of the catalytic burner 10, in which the mixing chamber 24 is provided essentially in the chamber 54 formed radially between the circumferential wall 14 of the burner housing 12 and the circumferential wall 20 of projection 18. A plurality of flow openings 62, through which the air arriving in the combustion air flow chamber 36 enters the mixing chamber 24 from the radially outside direction, are provided distributed in the circumferential direction in this axial area of the circumferential wall 14. The evaporator element 30 of the porous evaporator device 28, which said evaporator element 30 has an essentially cylindrical shape, is carried on the outer side of the circumferential wall 20 facing the circumferential wall 14 of the burner housing 12. The fuel feed line 34 feeds the fuel being fed in the liquid form through branch lines 64 into the evaporator element 30. The fuel vapor is evaporated from the surface of the evaporator element 30 facing the mixing chamber 24 and is mixed in the mixing chamber 24 with the combustion air fed into said mixing chamber.

Chamber 54, i.e., the mixing chamber 24 here, is defined axially by an area of the bottom wall 22 of the projection 18 projecting axially over the circumferential wall 20 of projection 18 and the catalyzer unit 48 at the end area located facing away from the bottom wall 16 of the evaporator housing 12. The fuel/combustion air mixture formed in the mixing chamber 24 flows through the ring-shaped intermediate chamber between the circumferential wall 14 of the burner housing 12 and the bottom wall 22 of projection 18 and thus enters the combustion chamber 44 through the catalyzer unit 48. Two flow diaphragms 56, 58 are provided there at axially spaced locations, each with a flow opening 58, 68 and with a catalyzer unit 52, 70 covering this.

The catalyzer unit 50, which now has an essentially cylindrical shape, is arranged downstream of the catalyzer unit 48. This [catalyzer unit] is located in the radial area of the circumferential wall 20 of the projection and divides the chamber 72 located axially between the bottom wall 22 of projection 18 and the flow diaphragm 56 into a radially outer chamber area 74 and a radially inner chamber area 76. The mixture passing through the catalyzer unit 48 and the combustion waste gases generated at the catalyzer unit 48 enter the chamber 48 or the radially outer chamber area 74 and flow through the essentially cylindrical catalyzer unit 50 in the radially inward direction, so that they enter the central area and hence the area of the flow opening 58 in the flow diaphragm 56. An additional stage of the catalytic reaction is obtained thereby in the area between the upstream flow diaphragm 56 and the outlet from the mixing chamber 24, especially in an area in which the velocity of flow is comparatively high.

It should be pointed out that the heating of the evaporator element can be achieved by heat transport. An electrically excitable heating means could, of course, also be arranged on the rear side of the evaporator element 30 facing away from the mixing chamber 24 in this embodiment as well.

Figure 6:
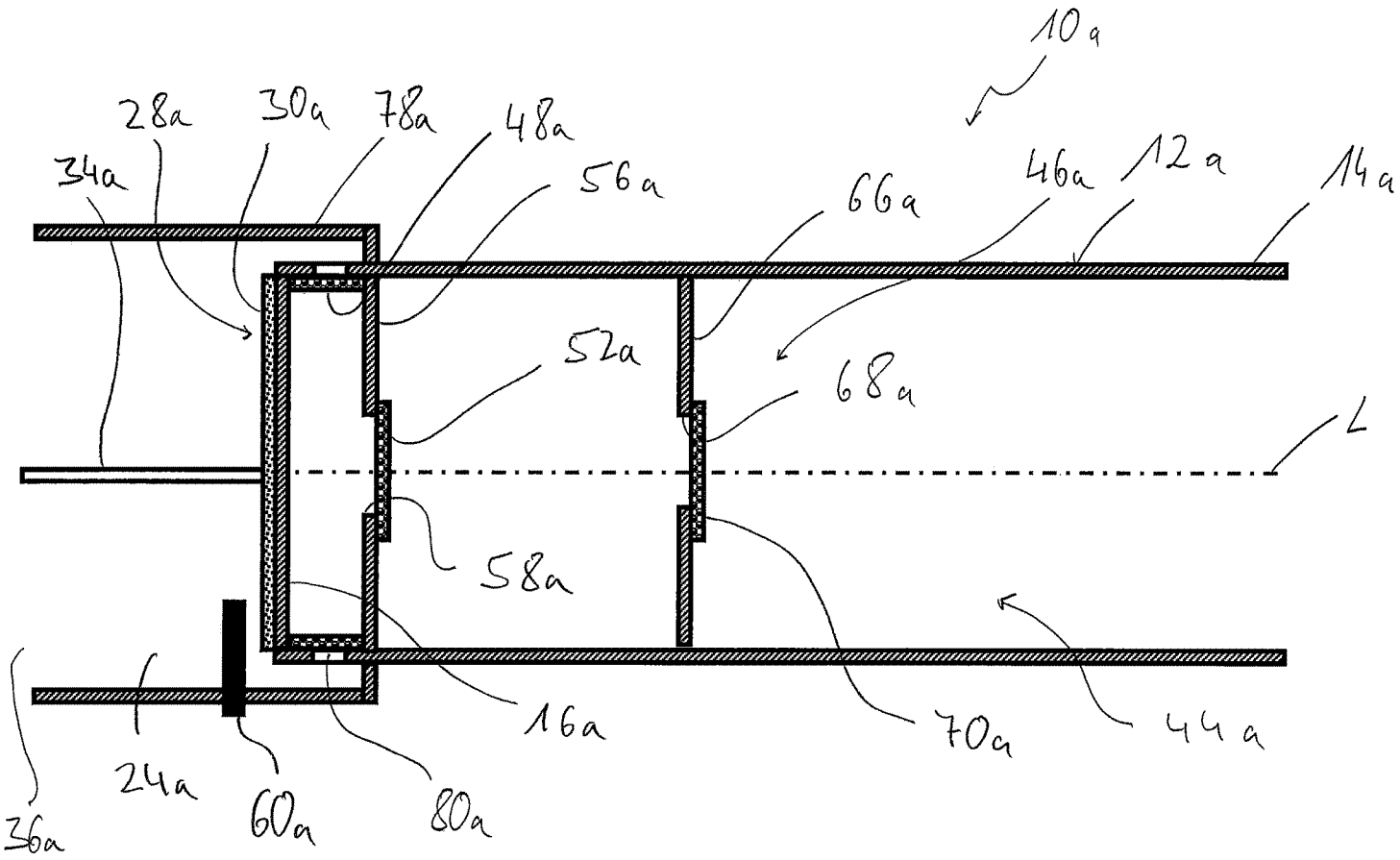
FIG. 6 is a longitudinal section of another alternative embodiment of a catalytic burner.

An alternative embodiment of a catalytic burner is shown in FIG. 6. Components and assembly units that correspond to the components and assembly units described above are designated by the same reference numbers followed by an "a."

The burner housing 12*a* is designed without the projection recognizable in the figures described above in the design of a catalytic burner 10*a* shown in FIG. 6. The circumferential wall 14*a* and the bottom wall 16*a* define the combustion chamber 44*a*. The mixing chamber 24*a* is formed upstream of this combustion chamber 44*a*, defined by another housing section 78*a* of the burner housing 12*a*. The fuel/combustion air mixture produced in the mixing chamber 24*a* enters the combustion chamber 44*a* through flow openings 80*a* formed in the circumferential wall 14*a* of the burner housing 12*a* close to the bottom wall 16*a* of the burner housing 12*a*. The catalyzer unit 48*a*, which has an essentially cylindrical shape here, is provided in the axial area in which the flow openings 80*a* are formed in the circumferential wall 14*a* on the inner side of the circumferential wall 14*a* facing the combustion chamber 44*a*, so that a first stage of the catalytic reaction can take place already at the time of entry into the combustion chamber 44*a*. This is then followed by the first flow diaphragm 56*a* with the catalyzer unit 58*a* provided thereon as well as the second flow diaphragm 66*a* with the catalyzer unit 70*a* provided thereon.

The porous evaporator device 28*a* or the porous evaporator element 30*a* thereof is carried on the side of the bottom wall 16*a* of the burner housing 24*a* facing away from the combustion chamber 44*a* and facing the mixing chamber 24*a*. The evaporator element 30*a* can be heated by the heat of combustion generated in the combustion chamber 44*a*. An electrically excitable heating means could, of course, be provided here as well between the evaporator element 30*a* and the bottom wall 16*a*. The evaporator element 30*a* is essentially planar, disk-shaped advantageously covers the entire outer side of the bottom wall 16*a*.

Figure 7:
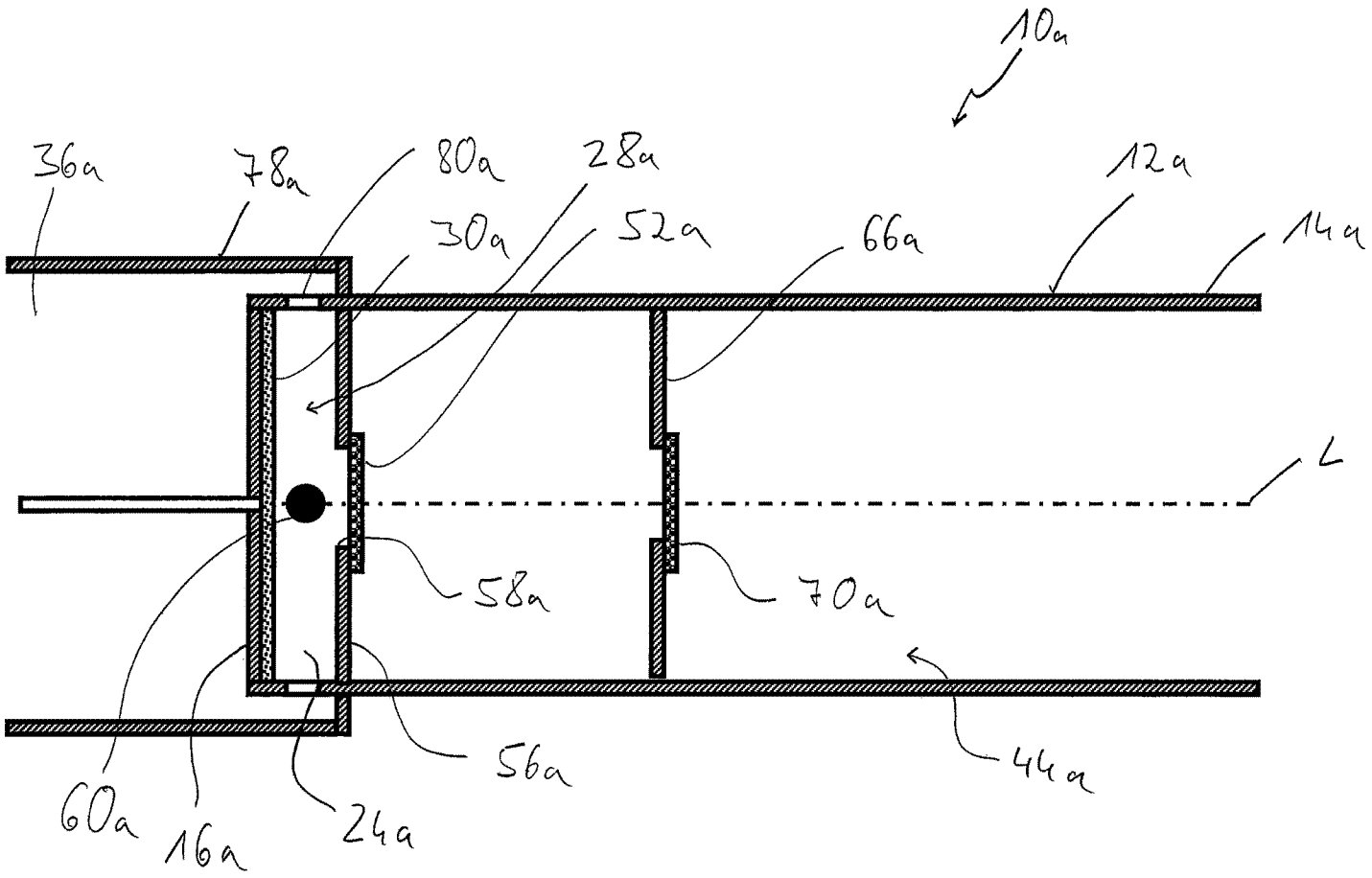
FIG. 7 is a longitudinal section of a variant of the catalytic burner shown in FIG. 6.

FIG. 7 shows a variant of the design shown in FIG. 6. The evaporator element 30*a* of the porous evaporator device 28*a* is provided in this design on the side of the bottom wall 16*a* of the burner housing 12*a* facing the combustion chamber 44*a*. The combustion air fed via the combustion air flow chamber 36*a* enters the mixing chamber 24*a*, which is defined in this embodiment variant by the circumferential wall 14*a* and the bottom wall 16*a* of the burner housing 12*a* as well as by the flow diaphragm 56*a* that is the first flow diaphragm in the direction of flow, through the flow openings 80*a* provided close to the bottom wall 16*a* in the circumferential wall 14*a* of the burner housing 12*a*. The fuel/combustion air mixture formed in the mixing chamber 24*a* can enter the combustion chamber 44*a* through the flow opening 58*a* in the flow diaphragm 56*a* and hence through the catalyzer unit 52*a*.

An electrically excitable heating means could be provided for heating or for additionally heating the evaporator element 30*a* between this and the bottom wall 16*a* of the burner housing 12*a* in this embodiment as well. As an alternative or in addition, heating can take place by means of heat conduction or heat radiation from the area of the combustion chamber 44*a* or from assembly units adjoining this, especially the flow diaphragm 56*a* or the catalyzer unit 58*a* as well as also from the circumferential wall 14*a* of the burner housing 12*a*.

Figure 8:
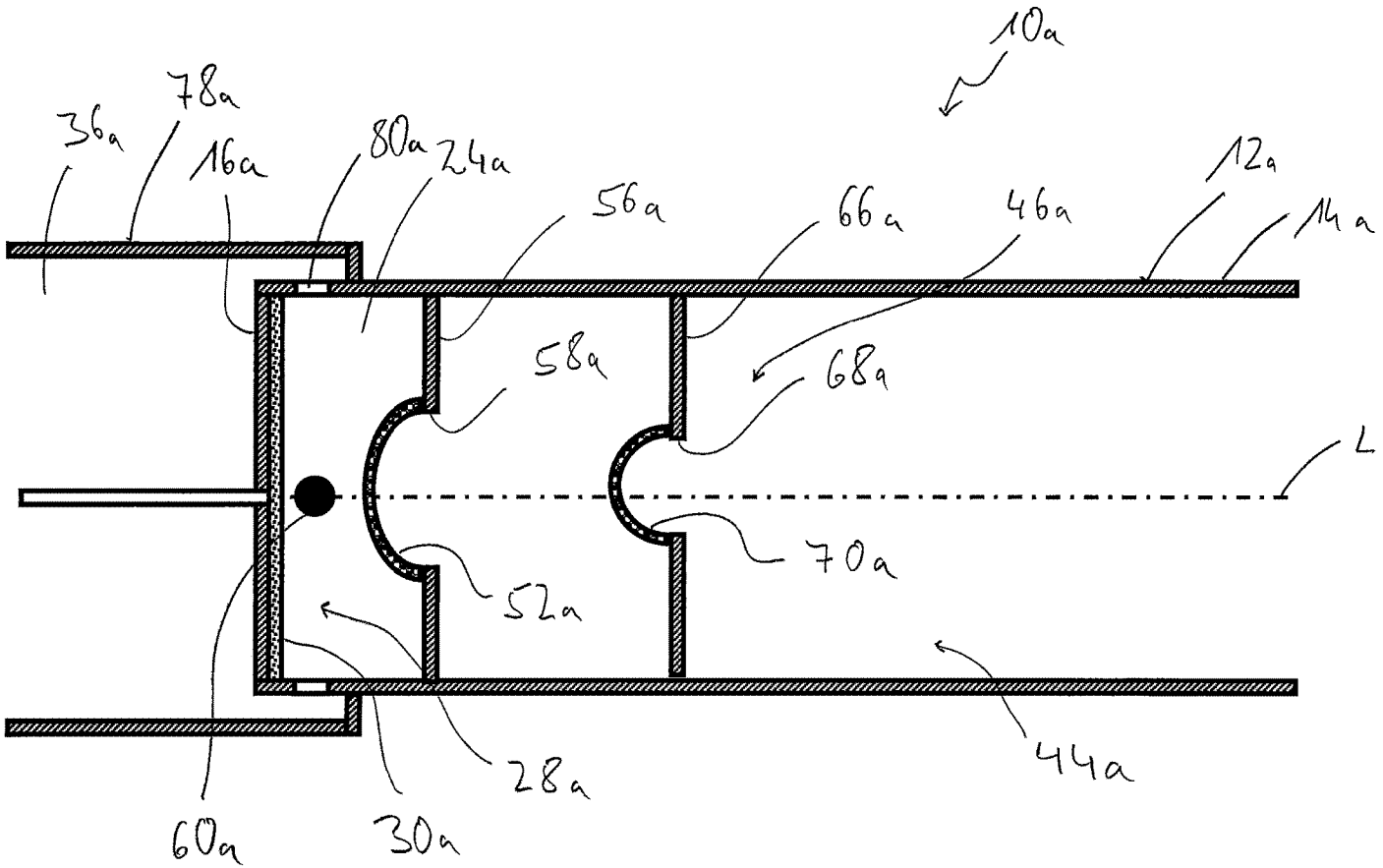
FIG. 8 is a longitudinal section of another variant of the catalytic burner shown in FIG. 6.

FIG. 8 shows a variant of the embodiment of the catalytic burner 10*a* shown in FIG. 7. It can be clearly recognized in FIG. 8 that the two catalyzer units 52*a*, 70*a* carried at the flow diaphragms 56*a*, 66*a* no longer have a planar configuration, but have an arched configuration. The arch is oriented in the upstream direction here. The surface of the catalyzer units 52*a*, 70*a* can be markedly enlarged due to this arched design of the catalyzer units 52*a*, 70*a*, while the size of the flow openings 58*a*, 68*a* is otherwise unchanged, which increases the efficiency of the catalytically supported combustion. Furthermore, it can be recognized in FIG. 8 that the flow openings 58*a*, 68*a* provided in the flow diaphragms 56*a*, 66*a* may have different sizes from one another. The two catalyzer units 52*a*, 70*a* also have correspondingly different dimensions.

It should be pointed out that especially the catalyzer units being carried at the respective flow diaphragms and, of course, also the catalyzer units being carried at other locations may, of course, also be provided with such an arch and with the surface enlargement generated thereby in all other embodiments. This embodiment can be easily obtained especially if, as was described above, the catalyzer units are designed with a grid-like support, preferably one made of a metallic material, which, made before or after the application of the catalyst material or optionally of catalyst material proper, can be brought to the desired installation configuration by shaping. Other shapes, for example, a conical or cylindrical shape of the catalyzer units, are, of course, possible as well. Arching in the downstream direction while maintaining the principle of enlarging the surface that can be used for the catalytic reaction is possible as well.

Figure 9:
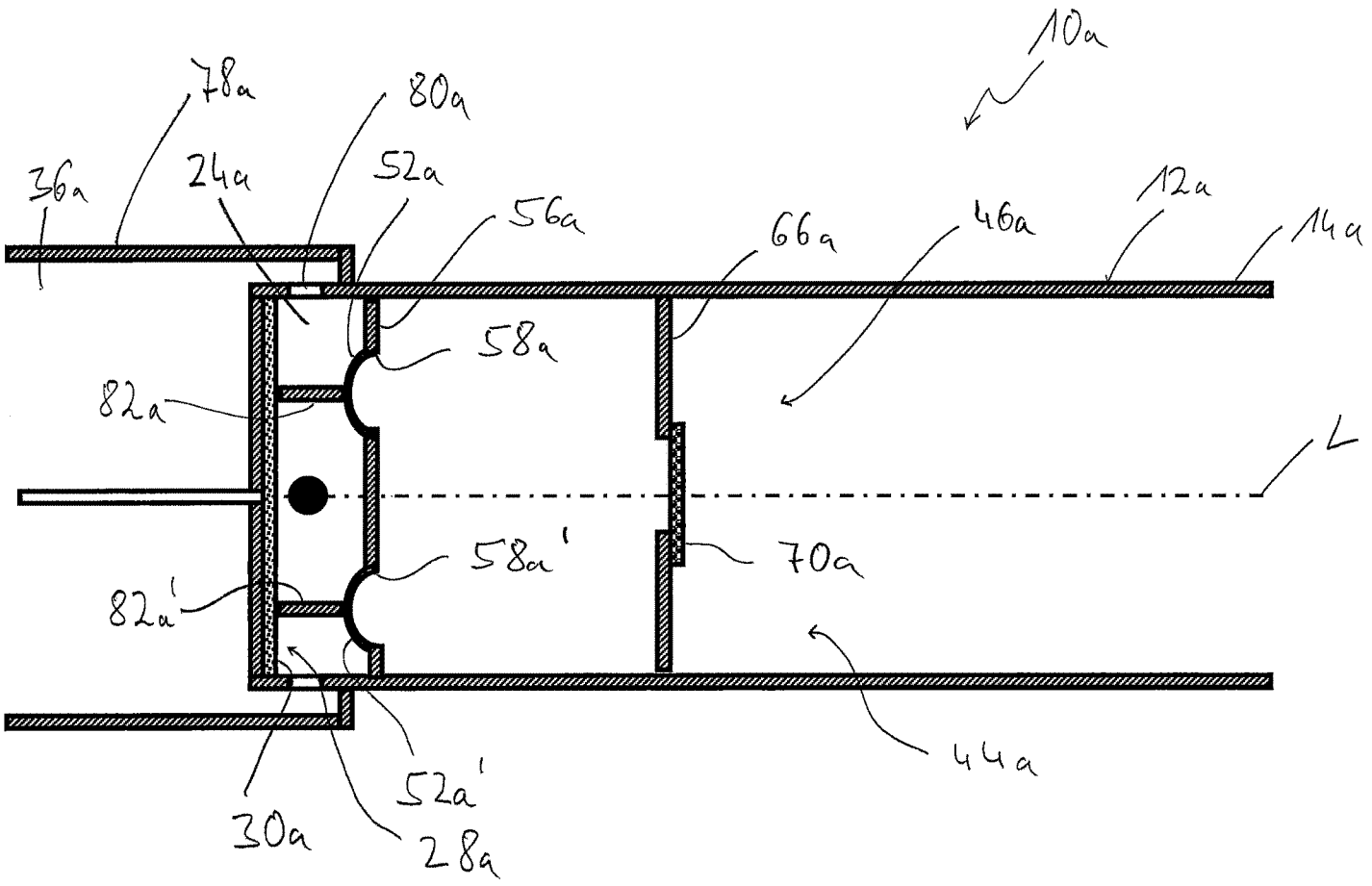
FIG. 9 is a longitudinal section of another variant of the catalytic burner shown in FIG. 6.

FIG. 9 shows another variant of the catalytic burner 10*a*. A plurality of flow openings 58*a*, 58*a*' are provided here in the flow diaphragm 56*a* axially defining the mixing chamber 24*a*. These are located eccentrically to the longitudinal axis L and may be provided in a ring-shaped pattern around the longitudinal axis L at equally spaced locations or/and with identical size or different sizes. A catalyzer unit 52*a*, 52*a*' is provided associated with each flow opening 58*a*, 58*a*'. As was shown above in reference to FIG. 8, these may be arched out, here in the direction of the mixing chamber 24*a*.

For example, web elements 82*a*, 82*a*' made of a metallic material, which ensure intensified heat transfer from the catalyzer units 52, 52*a*' to the evaporator element 30*a* and thus support the evaporation of the fuel from the evaporator element 30*a*, are located between the evaporator element 30*a* of the porous evaporator device 28*a* and the catalyzer units 52*a*, 52*a'*.

It should be pointed out that these web elements 82, 82*a*' may be provided independently from the shape and also the number and positioning of the catalyzer units 52*a*, 52*a*'. Furthermore, it should be pointed out that a different number of flow openings and catalyzer units associated therewith may, of course, be provided in the case of the flow diaphragms of the other embodiments as well. In particular, a central flow opening, which is consequently concentric to the longitudinal axis L and, surrounding this, a plurality of eccentrically positioned flow openings could be provided as well.

Figure 10:
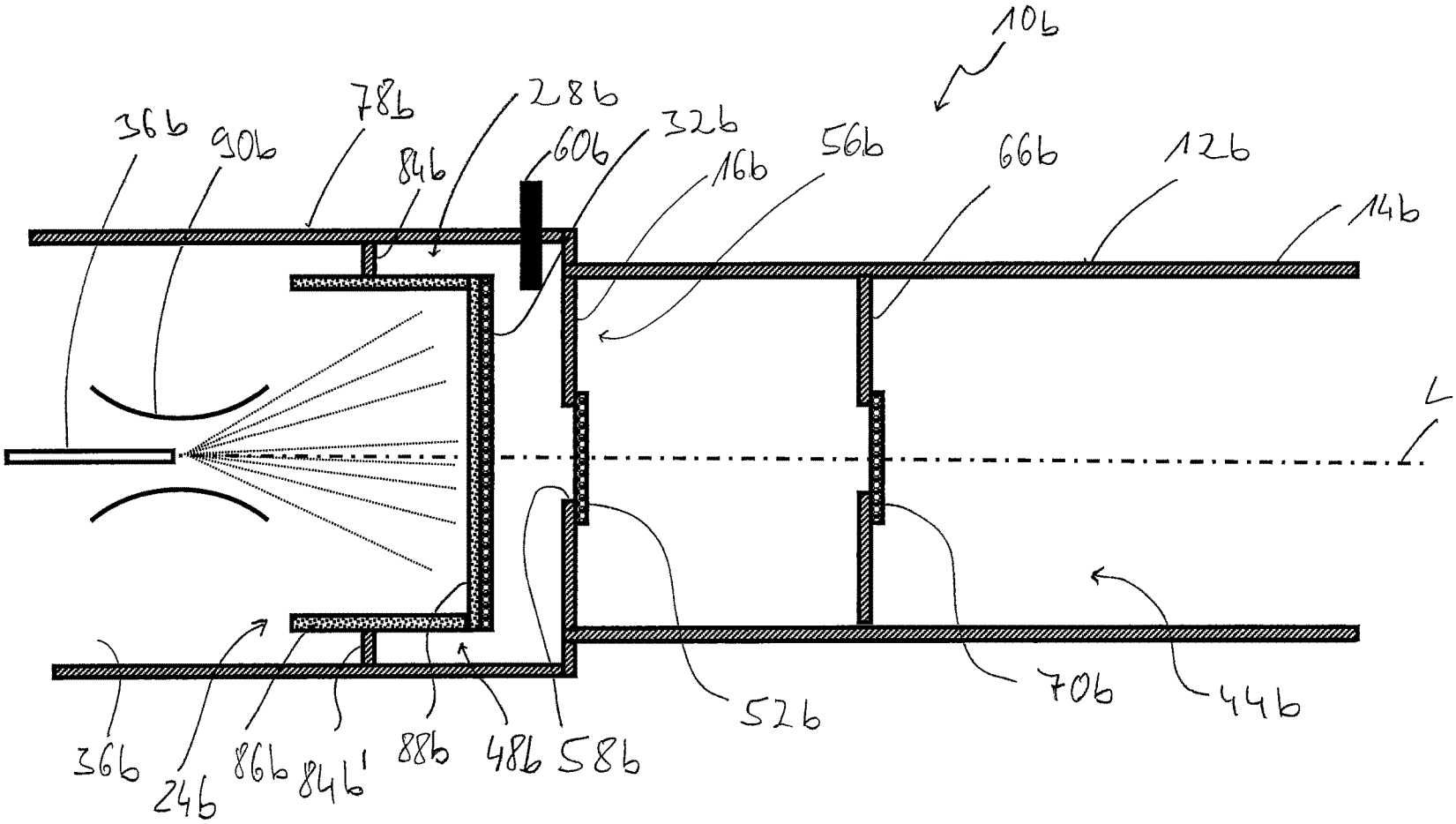
FIG. 10 is a longitudinal section of another alternative embodiment of a catalytic burner.

Another alternative embodiment of a catalytic burner is shown in FIG. 10. Components and assembly units that correspond to the components and assembly units described above in terms of design or function are designated by the same reference numbers followed by a "b."

In the design shown in FIG. 10, the further housing section 78*b* of the burner housing 12 forms essentially the mixing chamber 24*b* upstream of the circumferential wall 14*b* and of the bottom wall 16*b* of the burner housing 12*b*, which said bottom wall acts as a flow diaphragm 56*b*. The porous evaporator device 28*b* made with a pot-like shape is carried in this further housing section 78*b* via a plurality of webs 84*b*, 84*b*'. This [porous evaporator device] comprises a circumferential area 86*b* as well as a bottom wall area 88*b*, which is made, for example, integrally in one piece therewith and which is positioned axially opposite the bottom wall 16*b* of the evaporator housing 12*b*.

The fuel feed line 36*b* ends in a nozzle area 90*b* designed, for example, in the manner of a venturi tube already before the porous evaporator device 28*b*. The fuel released from the fuel feed line 36*b* in the liquid form, for example, in the form of droplets, is delivered by a part of the combustion air being delivered in the combustion air flow chamber 36*b* through the nozzle area 90*b* in the direction of the inner area of the pot-like porous evaporator device 28*b*. The fuel reaches the inner surface of the porous evaporator device 28*b*, is absorbed by this and is removed in the vapor form on the surface of said evaporator device, especially the surface facing outward, by the combustion air stream flowing along said surface.

An electrically excitable heating means 32*b* carried on the outer side of the bottom wall area 28*b* can be used to heat the porous evaporator device 28*b*. Said heating means can be energized via the webs 84*b*, 84*b*' carrying the porous evaporator device 28*b* in an electrically insulated manner.

To carry out a first stage of the catalytic reaction already where the mixing of combustion air and fuel begins, i.e., on the surface of the porous evaporator device 28*b*, the porous evaporator device may be provided, for example, coated, with catalyst material on its surface, so that a first catalyzer unit 48*b* is already formed in this area. It can consequently be recognized here that the volume area that is used as a mixing chamber 24*b*, on the one hand, namely, the volume area containing the porous evaporator device 28*b* in the additional housing section 78*b* can also be used in part as a combustion chamber or as part of the combustion chamber 44*b*. The functions are consequently combined here by generating fuel vapor, on the one hand, and by providing a catalyzer unit, on the other hand, in the porous evaporator device 28*b*. The functions are also combined in the use of a volume area as a mixing chamber 24*b*, on the one hand, and as part of the combustion chamber 44*b*, on the other hand. It should be pointed out that, in particular, this combination of functions can also be achieved in the embodiments described above by complete mixing of the fuel vapor with the combustion air being able to take place not only in the mixing chamber but also in the parts of the combustion chamber still following same.

While specific embodiments of the invention have been shown and described in detail to illustrate the application of the principles of the invention, it will be understood that the invention may be embodied otherwise without departing from such principles.

What is claimed is:

1. A catalytic burner for the catalytically supported combustion of a fuel/combustion air mixture, the catalytic burner comprising:

a mixing chamber;

a combustion air feed device feeding combustion air to the mixing chamber;

a fuel feed device feeding fuel to the mixing chamber;

a catalyzer device downstream of the mixing chamber, the catalyzer device comprising at least one catalyzer unit, through which the fuel/combustion air mixture flows, the fuel feed device comprising a porous evaporator device receiving liquid fuel from a fuel feed line and releasing fuel vapor into the mixing chamber;

a burner housing with a bottom wall and with a circumferential wall defining a combustion chamber downstream of the mixing chamber and containing the at least one catalyzer unit;

a projection provided at the bottom wall of the burner housing, the projection having a circumferential wall surrounded by the circumferential wall of the burner housing and extending from the bottom wall of the burner housing, the projection having a bottom wall arranged at a distal end of the projection in relation to the bottom wall of the burner housing, in the direction of a catalytic burner longitudinal axis, wherein the mixing chamber is provided in the interior of the projection, and at least one part of the porous evaporator device is carried at the bottom wall of the projection;

at least one part of the porous evaporator device provided at at least the bottom wall of the projection on a side of the at least the bottom wall of the projection facing away from the combustion chamber, wherein one of the at least one catalyzer unit is arranged spaced apart from the circumferential wall of the projection.

2. A catalytic burner in accordance with claim 1, wherein at least one of:

at least one flow opening is provided in an area of the circumferential wall of the projection, located adjacent to the bottom wall of the projection; and at least one flow opening is provided in an area of the circumferential wall of the projection, located adjacent to the bottom wall of the burner housing.

3. A catalytic burner in accordance with claim 1, wherein at least one and preferably each flow opening in the circumferential wall of the projection is covered by one of the at least one catalyzer unit.

4. A catalytic burner in accordance with claim 3, wherein the at least one catalyzer unit is provided on an outer side of the circumferential wall of the projection, facing the combustion chamber.

5. A catalytic burner in accordance with claim 1, wherein at least one part of the porous evaporator device is provided on a side of the circumferential wall of the projection, facing the circumferential wall of the burner housing; and at least one flow opening, leading to the mixing chamber, is provided in the circumferential wall of the burner housing, in an area of axial extension of the projection.

6. A catalytic burner in accordance with claim 1, wherein a chamber is formed between the circumferential wall of the burner housing and the circumferential wall of the projection and is defined at least partially by the at least one catalyzer unit at an end area located at a distance from the bottom wall of the burner housing.

7. A catalytic burner in accordance with claim 1, further comprising a flow diaphragm with at least one flow opening, the flow diaphragm being provided at the circumferential wall of the burner housing and at least one flow opening is covered by the at least one catalyzer unit.

8. A catalytic burner in accordance with claim 7, wherein:

a chamber is formed axially between the projection and the flow diaphragm;

the chamber is divided by the catalyzer unit into a radially outer chamber area and a radially inner chamber area.

9. A catalytic burner in accordance with claim 1, wherein the at least one catalyzer unit is formed in the upstream direction or in the downstream direction with an arc shape, conical shape or cylindrical shape.

10. A catalytic burner in accordance with claim 1, further comprising an electrically excitable heating device associated with the porous evaporator device.

11. A catalytic burner in accordance with claim 1, wherein the at least one catalyzer unit comprises a grid support with catalyst material on a surface of the grid support.

12. A catalytic burner in accordance with claim 11, wherein the grid support is deformed to obtain the installed shape of the at least one catalyzer unit.

13. A catalytic burner in accordance with claim 1, wherein;

said one of said circumferential wall and said bottom wall of said projection have two diametrically opposite longer sides and two diametrically opposite shorter sides;

said side of said one of said circumferential wall and the bottom wall of said projection with said porous evaporator device is one of said longer sides of said one of said circumferential wall and said bottom wall of the projection.

* * * * *